US009664341B2

(12) United States Patent
Hikmet et al.

(10) Patent No.: US 9,664,341 B2
(45) Date of Patent: May 30, 2017

(54) LIGHT EMITTING ARRANGEMENT FOR IMPROVED COOLING

(71) Applicant: PHILIPS LIGHTING HOLDING B.V., Eindhoven (NL)

(72) Inventors: Rifat Ata Mustafa Hikmet, Eindhoven (NL); Barry Mos, Bocholt (BE); Christian Kleijnen, Ittervoort (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/906,989

(22) PCT Filed: Jul. 3, 2015

(86) PCT No.: PCT/EP2015/065220
§ 371 (c)(1),
(2) Date: Jan. 22, 2016

(87) PCT Pub. No.: WO2016/005285
PCT Pub. Date: Jan. 14, 2016

(65) Prior Publication Data

US 2017/0108172 A1 Apr. 20, 2017

(30) Foreign Application Priority Data

Jul. 8, 2014 (EP) ..... 14176062

(51) Int. Cl.
*F21V 29/00* (2015.01)
*F21K 9/232* (2016.01)
(Continued)

(52) U.S. Cl.
CPC ..... *F21K 9/232* (2016.08); *F21K 9/64* (2016.08); *F21V 7/0025* (2013.01); *F21V 7/04* (2013.01); *F21V 29/60* (2015.01)

(58) Field of Classification Search
CPC ..... F21K 9/232; F21K 9/64; F21V 7/0025; F21V 7/04; F21V 29/60
See application file for complete search history.

(56) References Cited

U.S. PATENT DOCUMENTS 7,618,157 B1 11/2009 Galvez et al.
2009/0103296 A1 4/2009 Harbers et al.
(Continued)

FOREIGN PATENT DOCUMENTS

WO 2011109094 A1 9/2011
WO 2013060825 A1 5/2013

*Primary Examiner* — Thomas M Sember

(57) ABSTRACT

A light emitting arrangement is provided, comprising: an array of light-emitting elements (20) arranged on a carrier (10) having an inner surface (11) facing an interior space at least partially enclosed by said carrier, and an outer surface (12), and wherein the light emitting elements (20) are arranged to emit light towards the interior space, and a tubular wavelength converting member (30) having an envelope body comprising a light-receiving inner envelope surface (31) facing an interior space partially enclosed by said wavelength converting member, and an outer envelope surface (32), the wavelength converting member (30) being arranged adjacent said carrier (10) to receive light emitted by said light emitting elements (20) via said light-receiving inner envelope surface (31). The light emitting arrangement offers improved cooling and enables high lumen output without overheating.

14 Claims, 6 Drawing Sheets

(51) Int. Cl.

| | |
|---|---|
| ***F21K 9/64*** | (2016.01) |
| ***F21V 7/00*** | (2006.01) |
| ***F21V 7/04*** | (2006.01) |
| ***F21V 29/60*** | (2015.01) |

(56) References Cited

U.S. PATENT DOCUMENTS

| | | | |
|---|---|---|---|
| 2009/0273918 | A1 | 11/2009 | Falicoff et al. |
| 2010/0309646 | A1 | 12/2010 | Morikawa et al. |
| 2011/0215345 | A1 | 9/2011 | Tarsa et al. |
| 2011/0309735 | A1 | 12/2011 | Parker et al. |
| 2012/0236590 | A1 | 9/2012 | Parker et al. |
| 2013/0058082 | A1 | 3/2013 | Hirsh et al. |

LIGHT EMITTING ARRANGEMENT FOR IMPROVED COOLING

CROSS-REFERENCE TO PRIOR APPLICATIONS

This application is the U.S. National Phase application under 35 U.S.C. §371 of International Application No. PCT/EP2015/065220, filed on Jul. 3, 2015, which claims the benefit of European Patent Application No. 14176062.9, filed on Jul. 8, 2014. These applications are hereby incorporated by reference herein.

FIELD OF THE INVENTION

The present invention relates to solid state light emitting arrangements, especially such suitable for replacement of conventional lamps.

BACKGROUND OF THE INVENTION

Replacement of incandescent lamps for the reason of environmental concern is currently being performed by energy saving fluorescent lamps and by solid state solutions, in particular light-emitting diodes (LEDs). While fluorescent lamps extract about 6 times more light per watt and have a lifetime of up to 10,000 hours, which is 10 times longer than incandescent lamps, a LED lamp requires 90% less energy than an incandescent lamp and 50% less than an energy saving fluorescent lamp, and it can burn up to 50,000 hours. Other advantages of LED lamps with respect to fluorescent lamps are in the instant switching on, the possibility of dimming and the use of environmental friendly components, which can be disposed as normal waste, since no mercury is present. The transition to LED based lighting is in full execution with respect to low lumen output bulbs.

In incandescent bulb replacement lamps based on LEDs, commonly referred to as "retrofit lamps" since these LED lamps are often designed to have the appearance of a traditional light bulb and to be mounted in conventional sockets etc., the light emitting filament wire is replaced with one or more LEDs. The atmosphere within the bulb may be air or helium. However, a problem with LED based retrofit lamps is the cooling of the LEDs. Overheating of LEDs can lead to reduced lifetime, decreased light output or failure of the LEDs. Due to inadequate cooling some types of lamps have so far not been possible to realize, in particular high lumen output LED lamps for replacement of incandescent lamps producing 60, 75 or 100 W.

Hence there is a need in the art for improved LED based lamps, capable of replacing incandescent light having high lumen output.

SUMMARY OF THE INVENTION

It is an object of the present invention to overcome this problem, and to provide a light emitting arrangement offering improved heat management.

According to a first aspect of the invention, this and other objects are achieved by a light emitting arrangement, comprising:

an array of light-emitting elements adapted to emit primary light arranged on an at least partly cylindrical or ring shaped carrier having an inner surface facing an interior space at least partially enclosed by said carrier, and an outer surface, and wherein the light emitting elements are arranged with their light emitting surface facing inward to emit light towards the interior space, and a tubular wavelength converting member having an envelope body comprising a light-receiving inner envelope surface facing an interior space partially enclosed by said wavelength converting member, and an outer envelope surface, the wavelength converting member being arranged adjacent said carrier to receive light emitted by said light emitting elements via said light-receiving inner envelope surface, the tubular wavelength converting member being adapted to convert part of primary light emitted by the light emitting elements into secondary light and to emit said secondary light from said inner envelope surface as well as from said outer envelope surface, and to transmit part of the primary light without conversion.

During operation, the light emitting elements primary emit light into the interior of the assembly and at least part of this light is received by a light-receiving inner surface of the wavelength converting member. Typically, the light emitting elements emit light in one direction only, this direction being inwards towards the interior of the assembly. Hence, the light emitting elements are arranged with their light-emitting surface facing inwards and their non-emitting back side facing outwards. This arrangement offers improved heat dissipation from the light emitting elements and the carrier, and further prevents the light emitting elements from heating each other. Furthermore, distributing the light emitting elements evenly around the circumference of the carrier also improves heat spreading and avoids as far as possible the light emitting elements heating each other.

As used herein, the term "tubular" refers to an elongated hollow structure, optionally having one or more open ends. At least a section of a tubular structure may have a closed envelope surface. In the context of the present invention "tubular" is intended to cover cylindrical structures as well as conical, truncated conical, funnel-shaped structures and similar structures having a circular cross-section, but also triangular, rectangular, and other polygonal structures having a polygonal cross-section. Preferably the wavelength converting member may have a conical or truncated conical shape. The tubular wavelength converting member may further have an aspect ratio that fits within a conventional bulb shape. For example, the diameter of the tubular wavelength converting member may be about 3 cm or less than 3 cm and the aspect ratio may then be about 4 or less than 4.

The carrier may be at least partially curved. Hence, the inner surface may be concave, and the outer surface may be convex.

The carrier is at least partly cylindrical or ring shaped. However the carrier is not necessarily closed but could have e.g. a spiral shape. The light-emitting elements may be uniformly distributed along said carrier. In embodiments, the light emitting elements may be arranged on an inner surface of the carrier to emit light into the interior space of the assembly. However it is also envisaged that the light emitting elements may be arranged on the exterior surface of a transparent carrier to emit light through the carrier into the interior of the assembly.

The carrier and the wavelength converting member may typically have cross-sections of the same or similar shape and size, so that they can easily be joined without excess leakage of primary light to the exterior. The carrier is typically aligned with said wavelength converting member to form a tubular assembly. The inner surface of the carrier may be at least partially reflective.

In embodiments, the wavelength converting member forms, or forms part of (e.g. together with a heat spreader) an open-ended tubular structure. "Open-ended" means at least one open end. In some embodiments, the tubular structure may have two open ends. Two open ends allows gas flow through the light emitting arrangement and enables a "chimney effect" which occurs when the temperature gradient within the tubular structure leads to movement of the gas through and around the structure. The result is further improved cooling of the light emitting arrangement.

In embodiments, the carrier may be arranged at an end, optionally an open end, of the tubular wavelength converting member. Alternatively, the carrier may be arranged on or arranged to form part of the envelope body of the tubular wavelength converting member, e.g. a central region of the envelope body. For example, the carrier may be arranged on the inner envelope surface in a circumferential direction.

In embodiments, the light emitting arrangement according further comprises at least one light redirecting element provided on said carrier to direct light emitted by said light emitting elements in the direction of the light-receiving inner envelope surface of the wavelength converting member. Examples of such light redirection elements include (specular) reflectors, TIR collimators, and freeform lenses. In particular, the light redirecting element may be a reflector. Optionally, a portion of the carrier can be adapted to have the function of a light redirecting element, i.e. the light redirecting element may be integrated with the carrier. A light redirecting element may additionally provide a cooling, if made of a heat conductive material such as metal.

The at least one light redirecting element may be arranged to direct light emitted by one light-emitting element away from another light-emitting element. Thus, at least one of said light-emitting elements may be prevented, by means of said light redirecting element, from receiving light emitted by another one of said light emitting elements. Such shielding light emitting elements from the light emitted by other light emitting elements improved optical efficiency.

In embodiments, each light emitting element may be provided with a light redirecting element.

In some variants, the carrier may be aligned with the wavelength converting member to form a tubular assembly and may thus form an open end of said tubular assembly. A light redirecting element may be arranged to prevent light from its associated light emitting element to escape from the tubular assembly at the end thereof where said carrier is positioned.

In embodiments, the light emitting arrangement further comprises a heat spreader connected to said carrier at a side of the carrier facing away from the wavelength converting member. Such an arrangement further improved heat transport away from the light emitting elements.

In a second aspect, the invention provides a lamp, especially a so-called retrofit lamp, comprising a light emitting assembly as described herein that is at least partially enclosed by an at least partially transparent envelope. The envelope may be filled with a gas, e.g., helium or air or mixtures therefrom, to improve heat transport and enable cooling by gas circulation around, within and/or through the light emitting arrangement.

The light emitting arrangement, or a lamp comprising the light emitting arrangement, may be adapted to provide a high lumen output, typically at least 400 lm such as a 400-1000 lumens. That is, the light emitting arrangement may comprise a sufficient amount of light emitting elements to produce at least 400 lm. Such high lumen output, without the overheating that leads to reduced lifetime, decreased light output and/or LED failure, is enabled by the excellent cooling effect provided by the light emitting arrangement according to the present invention.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions may be exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
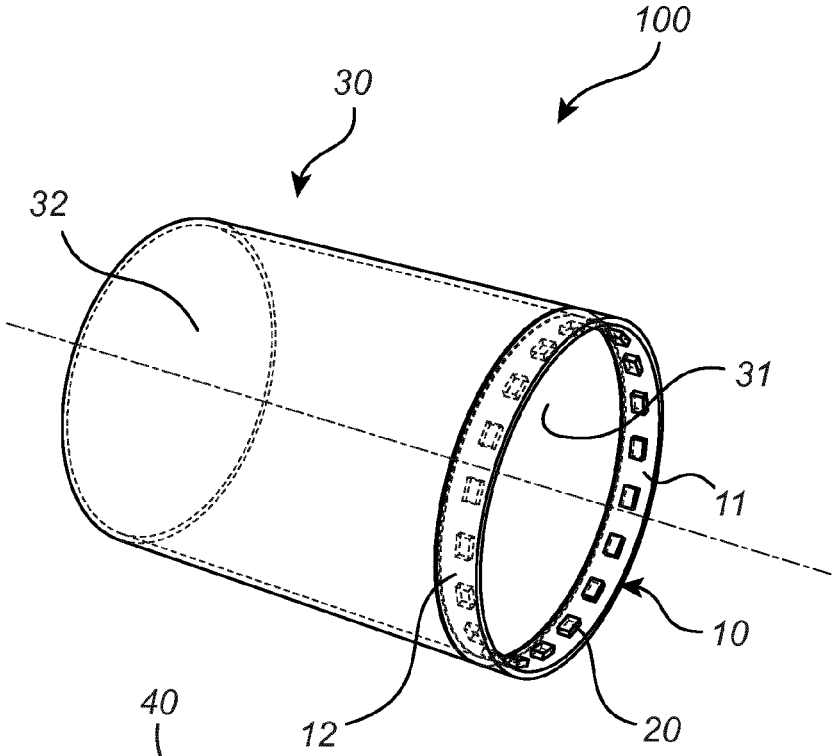
FIG. 1 shows a perspective view of a tubular assembly comprising a tubular wavelength converting member and a plurality of light emitting elements arranged on a carrier, according to embodiments of the invention.

FIG. 1 illustrates a tubular assembly 100 comprising a ring-shaped carrier 10 carrying a plurality of light-emitting elements 20, arranged at an end of a tubular wavelength converting member 30 having the shape of a cylinder. The cross-sections of the carrier 10 and the wavelength converting member 30 are matched so that they can form a uniform assembly. The light emitting elements 20, which may be blue-emitting LED chips, optionally packaged according to known measures, are arranged in a row on the inner, concave surface of the carrier. Typically the light emitting elements 20 are positioned along the carrier, preferably at equal distances from each other. For example the number of LED chips used may be in the range of 2 to 20, such as from 2 to 10, from 3 to 10, from 4 to 10 or from 5 to 10. Distributing the light emitting elements evenly around the circumference of the tubular assembly improves heat spreading and avoids as far as possible the light emitting elements heating each other.

During operation, the light emitting elements primary emit light into the interior of the assembly and at least part of this light is received by a light-receiving inner surface 31 of the wavelength converting member 30. Typically, the light emitting elements emit light in one direction only, this direction being inwards towards the interior of the assembly. Hence, the light emitting elements are arranged with their light-emitting surface facing inwards and their non-emitting back side facing outwards. This arrangement offers improved heat dissipation from the light emitting elements and the carrier, and further prevents the light emitting elements from heating each other. Optionally additional heat dissipation structures may be connected to the light emitting elements or the carrier on the exterior surface thereof in order to further improve heat spreading.

The wavelength converting member contains a wavelength converting material capable of converting primary light into secondary light, typically light of longer wavelength. The converted, secondary light is emitted from the wavelength converting member in all directions, including from the inner concave surface as well as from the outer, convex surface 32 facing the exterior, here also denoted light-emitting surface to distinguish it from the light receiving inner surface 31. The light-emitting outer convex surface 32 typically does not receive any of the primary light emitted by the light emitting elements 20.

In addition to emitting converted light, the wavelength converting member typically transmits part of the primary light emitted by the light-emitting elements 20 without conversion. Hence, in embodiments of the invention, the output light may comprise a mix of primary light and secondary (converted) light. Depending on the type of light emitting elements and the choice of wavelength converting material, the output light may be white light, or light of any desired color.

The light emitting elements may be LED dies or LED modules or packages. The light emitting elements may in particular be adapted to emit blue light. The plurality of light emitting elements may be adapted to produce a total lumen output in the range of from 400 to 100 lm, for example at least 500 lm or at least 700 lm.

The carrier on which the light emitting elements are arranged may for example be a printed circuit board (PCB), a flexfoil or a lead frame, which has a shape to fit with the tubular wavelength converting member. The carrier may be heat conductive, typically formed of a heat conductive material.

The wavelength converting member, and optionally any wavelength converting plate, typically comprises a luminescent material, or a mixture of several luminescent materials, for converting the primary light into secondary light having another spectral distribution. Suitable luminescent materials as used in embodiments of the invention include inorganic phosphors, such as doped YAG or LuAG, organic phosphors, organic fluorescent dyes, and quantum dots, which are highly suitable for the purposes of embodiments of the present invention.

Quantum dots are small crystals of semiconducting material generally having a width or diameter of only a few nanometers. When excited by incident light, a quantum dot emits light of a color determined by the size and material of the crystal. Light of a particular color can therefore be produced by adapting the size of the dots. Most known quantum dots with emission in the visible range are based on cadmium selenide (CdSe) with a shell such as cadmium sulfide (CdS) and zinc sulfide (ZnS). Cadmium free quantum dots such as indium phosphide (InP), and copper indium sulfide (CuInS2) and/or silver indium sulfide (AgInS2) can also be used. Quantum dots show very narrow emission band and thus they show saturated colors. Furthermore the emission color can easily be tuned by adapting the size of the quantum dots. Any type of quantum dot known in the art may be used in embodiments of the present invention. However, it may be preferred for reasons of environmental safety and concern to use cadmium-free quantum dots or at least quantum dots having very low cadmium content.

Organic fluorescent dyes have among other thing the advantage that their molecular structure can be designed such that the spectral peak position can be tuned. Examples of suitable organic fluorescent dyes materials for use in the present invention are organic luminescent materials based on perylene derivatives, for example compounds sold under the name Lumogen® by BASF. Examples of suitable compounds include, but are not limited to, Lumogen® Red F305, Lumogen® Orange F240, Lumogen® Yellow F083, and Lumogen® F170.

Examples of inorganic phosphor materials include, but are not limited to, cerium (Ce) doped YAG ($Y_3Al_5O_{12}$) or LuAG ($Lu_3Al_5O_{12}$). Ce doped YAG emits yellowish light, whereas Ce doped LuAG emits yellow-greenish light. Examples of other inorganic phosphors materials which emit red light may include, but are not limited to ECAS and BSSN; ECAS being $Ca_{1-x}AlSiN_3:Eu_x$ wherein $0<x\leq1$, preferably $0<x\leq0.2$; and BSSN being $Ba_{2-x-z}M_xSi_{5-y}Al_yN_{8-y}O_y:Eu_z$ wherein M represents Sr or Ca, $0\leq x\leq1$, $0\leq y\leq4$, and $0.0005\leq z\leq0.05$, and preferably $0\leq x\leq0.2$.

Figure 2:
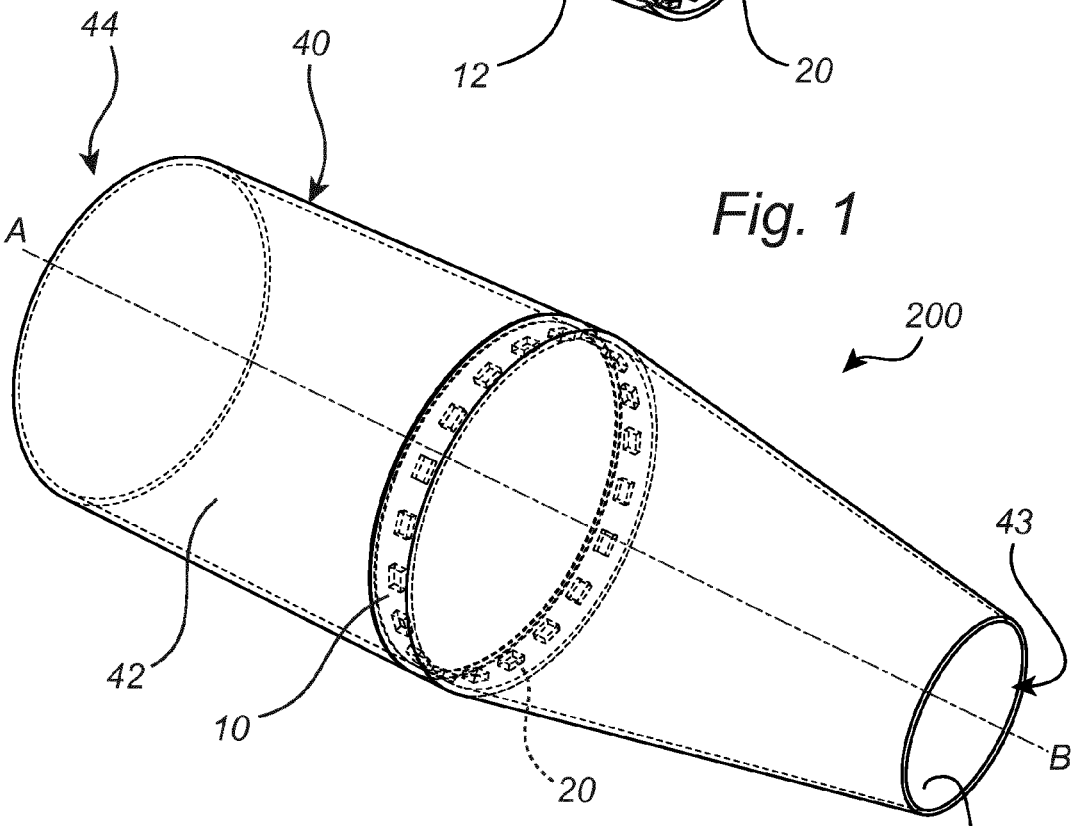
FIG. 2 shows a perspective view of another tubular assembly comprising a tubular wavelength converting member and a plurality of light emitting elements arranged on a carrier, according to embodiments of the invention.

FIG. 2 illustrates another tubular assembly 200 comprising a ring-shaped carrier 10 carrying a plurality of light emitting elements 20 and a wavelength converting member 40 having a light-receiving inner surface 41 and a light-emitting outer surface 42. The assembly 200 is similar to the assembly of FIG. 1, except for the particular shape of the wavelength converting member 40 and the position of the carrier 10. In the assembly shown in FIG. 2, the wavelength converting member 40 has a slightly conical shape, forming a truncated, hollow cone or a funnel. Furthermore, the carrier 10 is not arranged at the end of the wavelength converting member, but instead provided closer to the middle of the wavelength converting member 40, as seen in the longitudinal direction. It is however envisaged that the carrier 10 can be provided at any position between ends 43, 44 of the wavelength converting member 40. During operation the light-emitting elements 20 emit primary light into the interior of the tubular wavelength converting member 40, which primary light is received via the light-receiving inner surface 41 of the wavelength converting member and, after conversion, emitted as secondary light via inter alia the outer surface 42.

Although the wavelength converting body is depicted in FIGS. 1 and 2 as a cylinder, it may have any desirable shape, including conical, truncated conical, rectangular, triangular or (optionally truncated) pyramidal, etc.

While the tubular assembly of FIGS. 1 and 2 is shown as being open ended, in some embodiments it may be preferable to use an assembly which is closed at one or both ends. For example, at least one of the ends 43, 44 (referring to FIG. 2) may be closed by a reflective plate e.g. as described below with reference to FIG. 6 or by a wavelength converting plate. Another possibility is that the wavelength converting member is formed in one piece to have a closed end and one open end (which may, in turn, be closed by a reflective plate).

Figure 3:
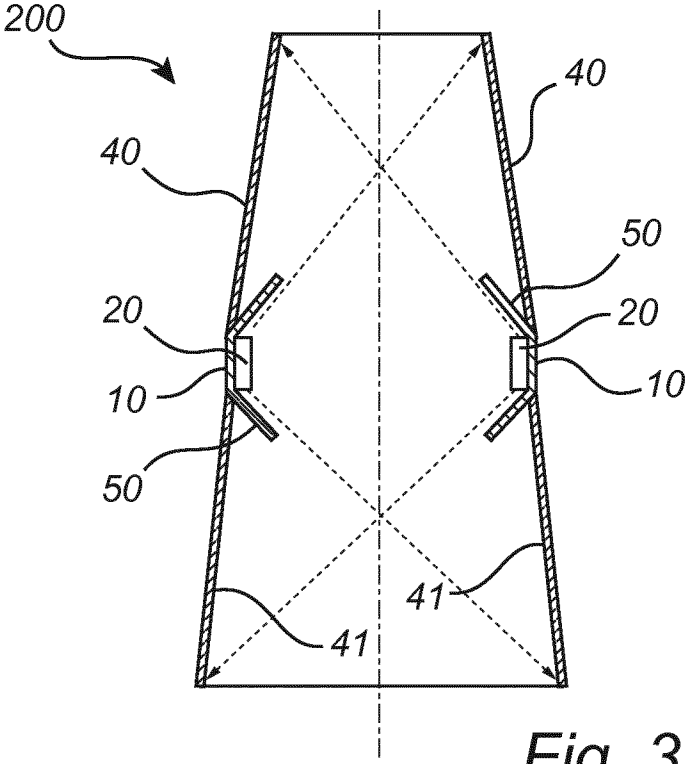
FIG. 3 shows a cross-sectional side view of the assembly of FIG. 2.

FIG. 3 shows a cross-sectional side view of the assembly 200 taken along the longitudinal axis indicated in FIG. 2. As shown in FIG. 3, light redirecting elements in the form of reflectors 50 are provided on the carrier 10 to surround each light emitting element 20 to direct light towards the light converting member. The reflectors 50 are made of a highly reflective material, typically a specular reflective material, with a high reflection coefficient. The reflector 50 directs light, preferably all light, emitted by the light-emitting element 20 directly or indirectly towards the light-receiving inner surface 41 of the wavelength converting member 40, The reflectors are typically shaped and arranged such as to prevent primary light emitted by the light emitting elements from directly escaping the tubular arrangement via the open end 43 or the open end 44. It is noted that the reflectors illustrated in FIG. 3 are equally applicable to an embodiment using a cylindrical wavelength converting member.

The reflectors may be formed as an integral part of the carrier, e.g. formed with trim-and-form processing in the case where the carrier is a lead frame, or may be an additional part mounted on the carrier and attached e.g. by a welding process. Alternatively, the reflectors may form part of an LED package and thus be mounted together with the LED.

Optionally the reflectors may be heat conductive and contribute to dissipation of heat away from the light emitting elements.

Figure 4:
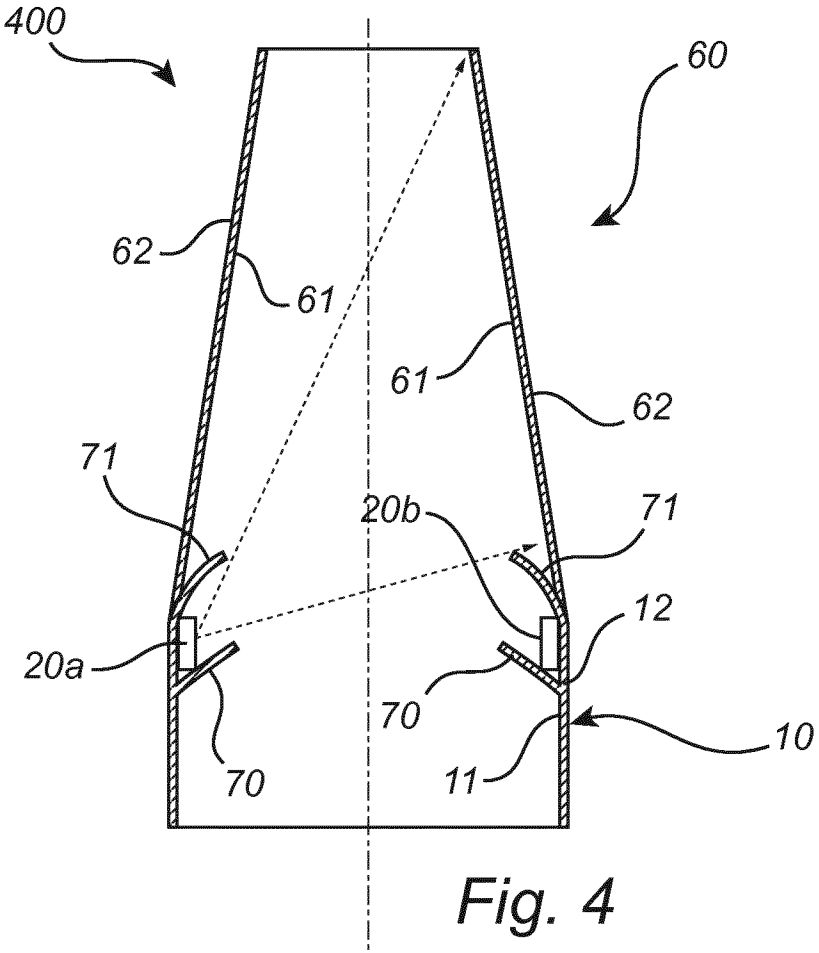
FIG. 4 shows a cross-sectional side view of another tubular assembly comprising a tubular wavelength converting member and a plurality of light emitting elements arranged on a carrier, according to embodiments of the invention.

FIG. 4 shows a cross-sectional side view of an assembly 400 with two open ends, comprising a ring-shaped carrier 10 carrying on its inner surface 11 a plurality of light-emitting elements 20*a*, 20*b*, and a wavelength converting member 60 having a light-receiving inner surface 61 and an outer surface 62. The light emitting elements 20 are arranged on the inner surface to emit primary light into the interior of the ring defined by the carrier 10 and towards the interior of the wavelength converting member 60 so the light is received by the light-receiving inner surface 61. Light redirecting elements in the form of reflectors or reflector portions 70, 71 are provided around each light-emitting element 20 to direct the primary light towards the wavelength converting member and to at least partially shield the lower (as seen in the figure) open end from light emission, so that preferably no light emitted from a light-emitting element 20 can escape directly from the assembly 400 without being received by the wavelength converting member or by being reflected at least once by a reflector 70 or by a reflective portion of the carrier 10. The reflector portion 70 having this escape shielding function may be arranged adjacent the light emitting element 20 on the opposite side thereof relative to the wavelength converting member 60. In particular, reflector portions 70 may arranged beneath the light emitting elements, as seen when the cylindrical or part-conical assembly is in an upright position, and inclined towards the light emitting elements. Additionally, a reflector portion 71 may be shaped to prevent light emitted by one light-emitting element 20*a* from directly reaching another light emitting element 20*b*, and vice versa, which improves the optical efficiency of the arrangement. In the embodiment shown in FIG. 4, the reflector portion 71 has a curved shape. As can be seen in FIG. 4, the reflectors portions 70, 71 may be asymmetric.

Each of the reflectors 70, 71 may be formed as an integral part of the carrier, an LED package, or as an additional part mounted on the carrier, and may optionally have a heat conductive function, as described above.

Figure 5:
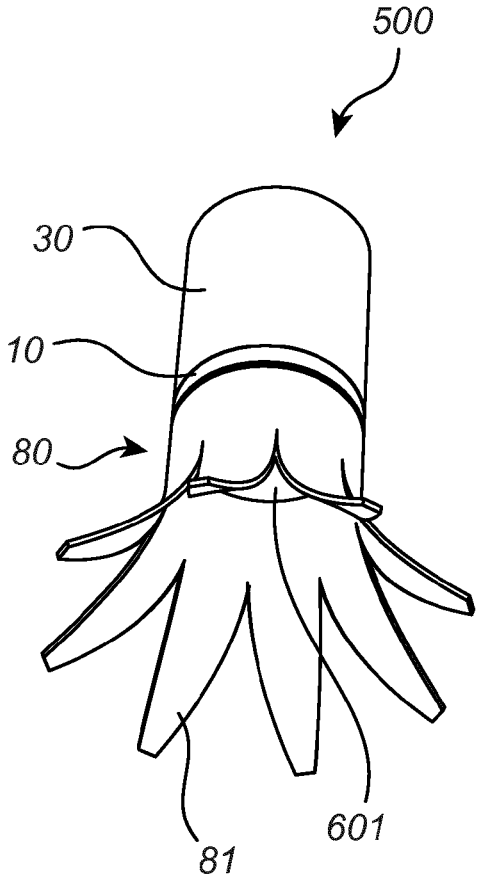
FIG. 5 shows a perspective view of another tubular assembly comprising a tubular wavelength converting member, a plurality of light emitting elements arranged on a carrier, and a heat spreader, according to embodiments of the invention.
Figure 6:
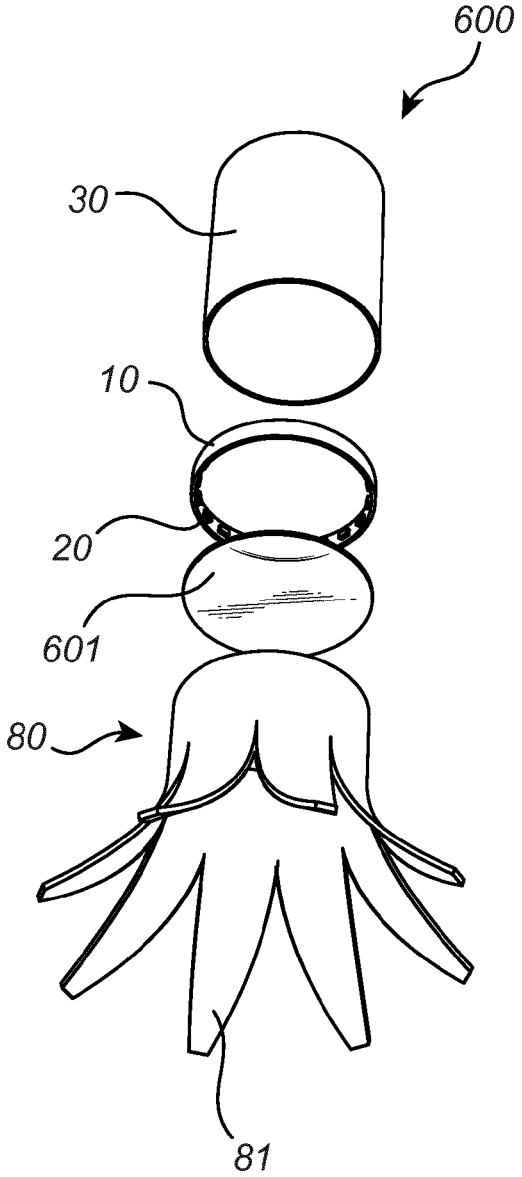
FIG. 6 shows an exploded view of the assembly of FIG. 5.

FIG. 5 illustrates a further embodiment of an assembly 500 for use in a light emitting arrangement. The assembly 500 comprises a tubular wavelength converting member 30 having a cylindrical shape, which may be similar to the wavelength converting member described above with reference to FIG. 1, and a plurality of light-emitting elements 20 arranged on a ring-shaped carrier 10. The carrier is connected to the wavelength converting member 30 at one of the open ends of the wavelength converting member. A heat spreader 80 is physically and thermally connected to the carrier 10. Typically the carrier is thermally conductive to transfer heat generated by the operation of the light-emitting elements 20 to the heat spreader, which may dissipate heat from the arrangement. Optionally, as shown in FIG. 6 which is an expanded view of a light emitting arrangement 600 which also comprises a heat spreader 80, a reflective plate 601 may form a lid to cover the end of the tubular assembly formed by the carrier 10 and the wavelength converting member 30.

The heat spreader 80 is formed of a thermally conductive material. Examples of suitable materials for heat spreaders are known to persons of skill in the art and comprise graphite, copper or and other highly thermally conductive material. The heat spreader may have a shape and size with a cross-section matching the carrier 10, e.g. a generally cylindrical or part-conical shape. However it is possible for the heat spreader to have any shape and to be attached to the carrier 10 at any suitable position. Typically, the heat spreader may have a large surface area. In the embodiments represented in FIGS. 5 and 6, the heat spreader has a cylindrical proximal portion connected to the wavelength converting member 30 and/or the carrier 10, and an expanded distal portion with a larger cross-section than the wavelength converting member. For example, the distal portion of the heat spreader may comprise one or more flanges arranged along the circumference of the cylindrical proximal portion. In other embodiments, the heat spreader may lack a cylindrical portion. In some embodiments, the heat spreader may be integrated with the carrier 10, e.g. such that the carrier 10 forms a cylindrical portion connected to the wavelength converting member. In such embodiments one or more flanges may be arranged along the circumference of said carrier or carrier portion of the heat spreader (see for example FIG. 9).

Figure 7:
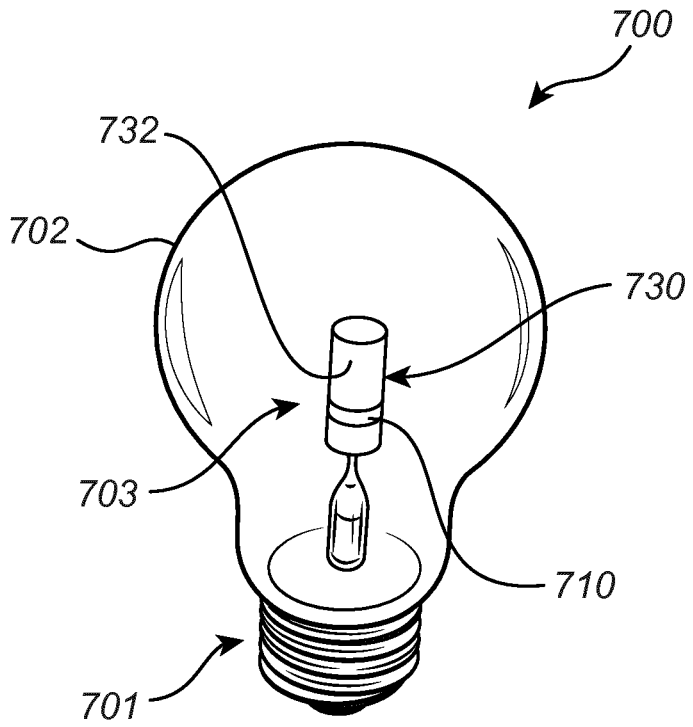
FIG. 7 shows a side view of a retrofit lamp comprising a light emitting assembly according to embodiments of the invention.
Figure 8:
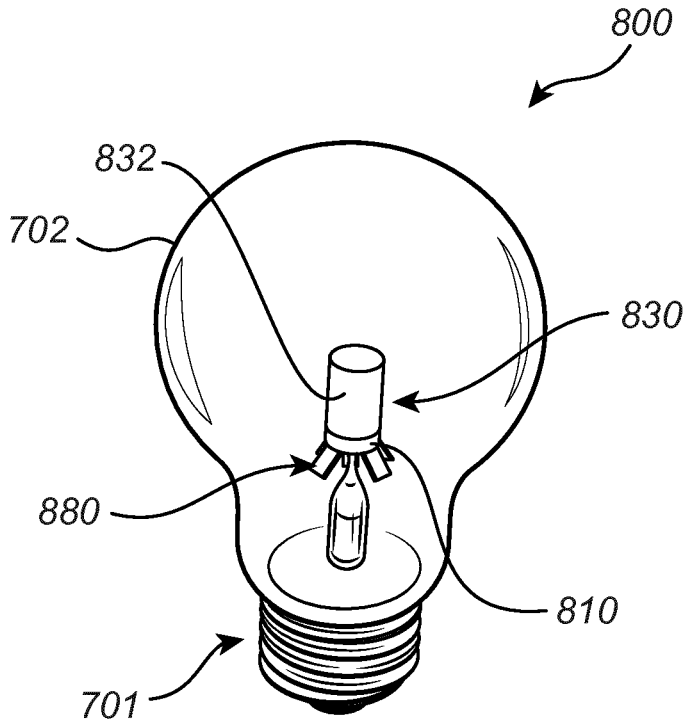
FIG. 8 shows a side view of a retrofit lamp comprising a light emitting assembly according to other embodiments of the invention.
Figure 9:
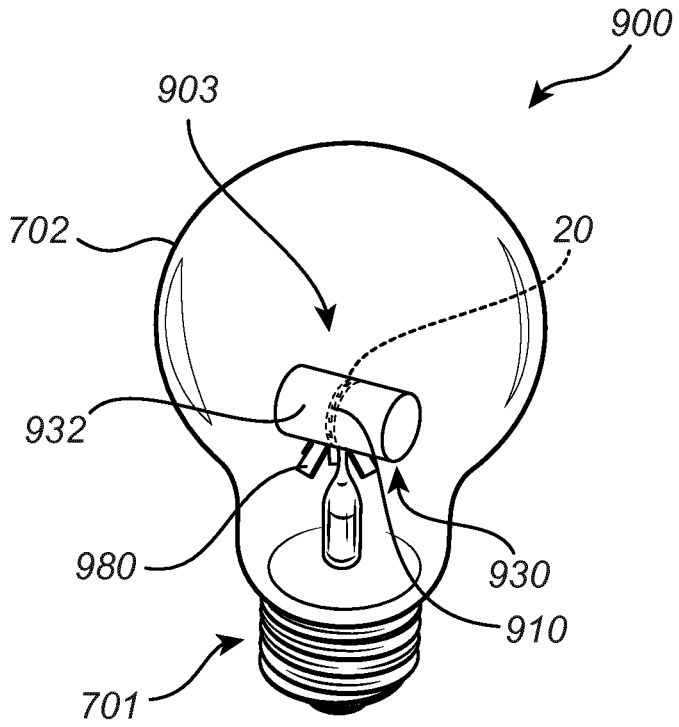
FIG. 9 shows a side view of a retrofit lamp comprising a light emitting assembly according to yet other embodiments of the invention.

FIGS. 7 to 9 illustrate the application of the present invention in a so-called retrofit lamp. FIG. 7 is a side view of a retro-fit lamp 700 which has a base 701 and an enclosure 702 which may have the shape of a conventional incandescent light bulb. The base is adapted to fit in a conventional socket for incandescent lamps. A light emitting arrangement 703 is provided within the enclosure and connected to suitable driving electronics (not shown) as appreciated by a skilled person. The light emitting arrangement 703 comprises a plurality of light emitting elements 20 arranged as an array on a ring-shaped carrier 710 which is inserted in or intersects the wavelength converting member. The light emitting elements (not shown) are arranged to emit light towards the interior of the ring defined by the carrier 710 and the tubular wavelength converting member 730 such that light is received by the light-receiving inner surface of the wavelength converting member. Converted light is emitted from the entire wavelength converting member, including the outer surface 732. Additionally, non-converted primary light may be transmitted by the wavelength converting member. As a result, the wavelength converting member is perceived as a light-emitting cylinder, providing uniform light emission which may be of high intensity.

The enclosure 702 may be transparent or translucent, e.g. frosted. The enclosure may be formed of glass or any other suitable material known to persons of skill in the art.

The space enclosed by the base 701 and the enclosure 702 may be filled with a gas, typically air or helium, in order to transport heat generated by the light emitting arrangement. Furthermore, the use of an open-ended tubular assembly may further improve cooling of the light emitting arrangement due to the "chimney effect" which occurs when the temperature gradient within the tubular assembly leads to flow of the gas through the tubular assembly and circulation within the enclosure 702.

To avoid obstructing gas flow within the enclosure 702, the tubular assembly may be arranged on one or more supporting wires connecting the base 701 to the end of tubular assembly.

FIG. 8 shows a side view of an embodiment of a lamp 800 similar to the lamp 700 shown in FIG. 7, but in the embodiment of FIG. 8, the light emitting arrangement comprises a carrier 810 arranged adjacent to and aligned with a tubular wavelength converting member 830, similar to embodiments described above e.g. with reference to FIGS. 1 and 4. The light emitting elements are arranged to emit light towards the interior of the ring defined by the carrier 810 and the tubular wavelength converting member 830 such that light is received by the light-receiving inner surface of the wavelength converting member. Converted light is emitted from the entire wavelength converting member, including the outer surface 832. Furthermore, a heat spreader 880 is arranged at the bottom portion of the light emitting arrangement, facing the base 701, to dissipate heat generated by the light-emitting elements during operation. Similarly to the embodiments illustrated in FIG. 7, the wavelength converting member 830 is arranged in a standing position, with one end including the heat spreader positioned closer to the base and the opposite, open end of the tubular wavelength converting member positioned farther away from the base.

Lastly, FIG. 9 shows a side view of yet another embodiment of a lamp 900 comprising a light emitting arrangement 903 including a plurality of light emitting elements (not shown) arranged on an inner surface of a circular carrier 910, and a wavelength converting member 930. The carrier 910 is inserted in or intersects the wavelength converting member as described above e.g. with reference to FIG. 2, 3 or 7. The light emitting elements are arranged to emit light towards the interior of the ring defined by the carrier 910 and the tubular wavelength converting member 930 such that light is received by the light-receiving inner surface of the wavelength converting member. Converted light is emitted from the entire wavelength converting member, including the outer surface 932. Unlike the embodiments shown in FIGS. 7 and 8, the light emitting arrangement 903 is not in an upright standing position, but is positioned with a portion of its envelope surface facing the base and both ends of the tubular wavelength converting member 930 facing the enclosure 702. Furthermore, the carrier 910 is physically attached and thermally connected to a heat spreader 980, which here consists of two flanges extending from the outer surface of the carrier 910 at a side thereof and facing the base 701. It is contemplated that the carrier 910 may constitute a part of the heat spreader as described above.

EXAMPLE

A wavelength converting member was produced by coating 2% YAG:Ce phosphor onto a poly(terephthalate) foil (PET foil). The foil also contained Lumogen F305, a red phosphor available from BASF. The foil was shaped to a cylindrical truncated cone with a height of 5 cm. A flex foil of Kapton with copper conducting tracks carrying 6 blue emitting chip scale packaged LEDs from Lumileds having a light-emitting surface of 0.5 $mm^2$ was formed to a ring (circumference of 72 mm) with the LEDs facing inside and was attached to the conical wavelength converting member using a heat spreader formed of a graphite film adhered to the Kapton film, having the shape of a ring with flaps. The LEDs were placed at a distance of 12 mm from each other on the Kapton flex foil.

A lamp was produced using a light emitting arrangement as described above arranged within a glass bulb.

Figure 10:
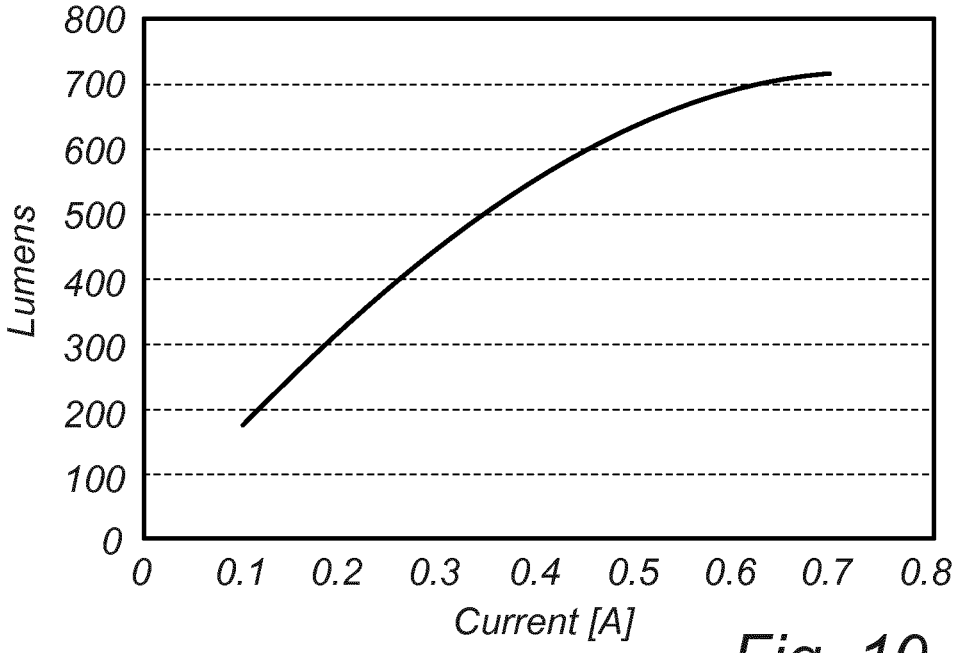
FIG. 10 is a graph showing the light output (lm) as a function of driving current (A) for a lamp comprising a light emitting arrangement according to embodiments of the invention.
Figure 11:
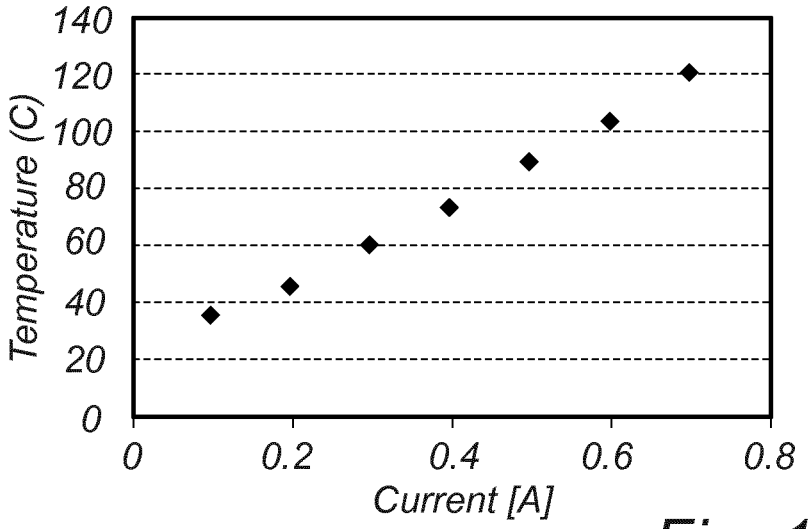
FIG. 11 is a graph showing the temperature (° C.) as a function of driving current (A) for a lamp comprising a light emitting arrangement according to embodiments of the invention.

Lumen output and temperature was recorded for increasing driving currents. FIG. 10 shows the output (lumens) as a function of the driving current (A). The temperature was measured at the back of the LEDs using a thermocouple. Total lumen output was measured in a calibrated integrating sphere. As can be seen in this figure, up to 700 lm can be produced with this setup without any substantial negative effect of heating. FIG. 11 shows the temperature (° C.) as a function of the driving current. At 0.7 A, which produced about 700 lm, the temperature reached 120° C., which is considered satisfactory for this application.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light emitting arrangement, comprising:

an array of light-emitting elements adapted to emit primary light arranged on a carrier, said carrier being at least partly cylindrical or ring shaped and having an inner surface facing an interior space at least partially enclosed by said carrier, and an outer surface, and wherein the light emitting elements are arranged with their light emitting surface facing inward to emit light towards the interior space, and a tubular wavelength converting member having an envelope body comprising a light-receiving inner envelope surface facing an interior space partially enclosed by said wavelength converting member, and an outer envelope surface, the wavelength converting member being arranged adjacent said carrier to receive light emitted by said light emitting elements via said light-receiving inner envelope surface, the tubular wavelength converting member being adapted to convert part of primary light emitted by the light emitting elements into secondary light and to emit said secondary light from said inner envelope surface as well as from said outer envelope surface, and to transmit part of the primary light without conversion.

2. A light emitting arrangement according to claim 1, wherein said wavelength converting member forms an open-ended tubular structure.

3. A light emitting arrangement according to claim 1, wherein said wavelength converting member has a conical or truncated conical shape.

4. A light emitting arrangement according to claim 1, wherein the carrier and the wavelength converting member have cross-sections of the same or similar shape and size.

5. A light emitting arrangement according to claim 1, wherein the carrier is aligned with said wavelength converting member to form a tubular assembly.

6. A light emitting arrangement according to claim 5, wherein said carrier is arranged at an open end of said tubular wavelength converting member.

7. A light emitting arrangement according to claim 6, further comprising a heat spreader connected to said carrier at a side of the carrier facing away from the wavelength converting member.

8. A light emitting arrangement according to claim 5, wherein said carrier is arranged on or arranged to form part of the envelope body of the tubular wavelength converting member.

9. A light emitting arrangement according to claim 1, wherein at least one light redirecting element is provided on said carrier to direct light emitted by said light emitting elements in the direction of the light-receiving inner envelope surface of the wavelength converting member.

10. A light emitting arrangement according to claim 9, wherein each light emitting element is provided with a light redirecting element.

11. A light emitting arrangement according to claim 9, wherein said light redirecting element is arranged to direct light emitted by one light-emitting element away from another light-emitting element.

12. A light emitting arrangement according to claim 11, wherein said light redirecting element is a reflector.

13. A light emitting arrangement according to claim 1, wherein the inner surface of said carrier is at least partially reflective.

14. A lamp comprising a light emitting assembly according to claim 1 at least partially enclosed by an at least partially transparent envelope.

* * * * *